US008109281B2

(12) United States Patent
Humele et al.

(10) Patent No.: US 8,109,281 B2
(45) Date of Patent: Feb. 7, 2012

(54) CLEANING ASSEMBLY FOR CONTAINERS

(75) Inventors: Heinz Humele, Thalmassing (DE); Franz Gmeiner, Sinzing Orsteil Eilsbrunn (DE); Kersten Thomas, Drelsdorf (DE); Uerike Thoms, legal representative, Drelsdorf (DE); Timm Kirchhoff, Westerholz (DE); Bernd Hansen, Rantrum (DE); Jan Momsen, Flensburg (DE)

(73) Assignee: Krones AG, Neutraubling (DE)

( * ) Notice: Subject to any disclaimer, the term of this patent is extended or adjusted under 35 U.S.C. 154(b) by 297 days.

(21) Appl. No.: 12/366,260

(22) Filed: Feb. 5, 2009

(65) Prior Publication Data

US 2009/0288686 A1 Nov. 26, 2009

(30) Foreign Application Priority Data

Feb. 11, 2008 (DE) ..... 10 2008 008 529

(51) Int. Cl.
*B08B 9/20* (2006.01)

(52) U.S. Cl. ..... 134/48; 134/66; 134/70; 134/78; 134/79; 134/80; 141/168; 422/301; 422/302

(58) Field of Classification Search ..... 134/48, 134/66–70, 77–80; 422/301–304; 141/163, 141/168

See application file for complete search history.

(56) References Cited

U.S. PATENT DOCUMENTS

| | | | | |
|---|---|---|---|---|
| 4,017,330 | A * | 4/1977 | Aidlin et al. | 134/21 |
| 5,494,086 | A * | 2/1996 | McBrady et al. | 141/163 |
| 6,024,917 | A * | 2/2000 | Kamstra | 422/33 |
| 6,830,084 | B1 | 12/2004 | Friede | |

FOREIGN PATENT DOCUMENTS

| | | |
|---|---|---|
| DE | 4425808 A1 | 2/1996 |
| DE | 69713157 T2 | 1/2003 |
| DE | 10145803 A1 | 4/2003 |
| EP | 0536530 | 4/1993 |

* cited by examiner

*Primary Examiner* — Michael Barr
*Assistant Examiner* — Saeed T Chaudhry
(74) *Attorney, Agent, or Firm* — Marshall, Gerstein & Borun LLP

(57) ABSTRACT

A cleaning assembly for containers, particularly for bottles, having a conveying device on which the containers are arranged by means of a receptacle means. To economically and ecologically improve the cleaning assembly, the receptacle means contains a liquid-tight tubular for an individual cleaning of the containers.

14 Claims, 2 Drawing Sheets

CLEANING ASSEMBLY FOR CONTAINERS

CROSS-REFERENCE TO RELATED APPLICATION

The present application claims the benefit of priority of German Patent Application No. 102008008529.4, filed Feb. 11, 2008. The entire text of the priority application is incorporated herein by reference in its entirety.

FIELD OF THE DISCLOSURE

The present disclosure refers to a cleaning assembly for containers, particularly bottles, such as for beverage bottling operations.

BACKGROUND

Such a cleaning assembly is e.g. known from EP 536530. The known cleaning assembly contains a conveying device formed as an endless chain and comprises a plurality of accommodation means into which the bottles can be fitted. The bottles are then conveyed through the cleaning container in a freely suspended manner, said cleaning container being filled with a cleaning agent. To give the cleaning agent sufficient time to unfold its cleaning effect, the conveying device is guided within the cleaning container via a dwell time path, i.e. the conveying device is guided e.g. over spiral or helical paths prolonging the conveying path and thus the contact time with the cleaning agent. However, the bottles must remain completely submersed in the cleaning bath over the entire dwell time path, i.e. the cleaning bath requires a lot of space; and it has a considerable weight. Additionally, the cleaning agent must be kept in the entire cleaning container at an increased temperature, which requires enormous energy. Furthermore, a large amount of cleaning agent is required, which must be correctly disposed of after consumption.

SUMMARY OF THE DISCLOSURE

One aspect of the disclosure is to provide an energy and space saving cleaning assembly that uses cleaning agent sparingly.

An individual cleaning of the container in its own tubular is possible by using a liquid-tight tubular according to the disclosure so that the large-volume cleaning baths with their static requirements due to their high weight (40 to 60 t) are no longer needed. Furthermore, the treatment temperature can be lowered and the processing time can be reduced. At the same time, the amount of cleaning agent and fresh water consumption is significantly reduced.

The tubulars are preferably dimensioned such that at least one container can be received and can completely be submersed into the cleaning agent located in the tubular, wherein the tubular is preferably adapted such that the container can be submersed with its filling opening pointing upwards, i.e. in an upright standing manner, into the cleaning bath.

Caused by a heat insulation of the tubular, the temperature of the cleaning agent can possibly also be sustained without additional heating over the entire duration of the cleaning procedure.

It is also advantageous to equip the tubular with a means for intensifying the cleaning effect, i.e. to take care that the cleaning agent in the tubular is set in motion, since thereby the dwelling time of the containers in the tubular can be shortened.

A closure of the tubular on the one hand prevents a heat loss and on the other hand the loss of cleaning agent by unintended shocks during the conveying process.

The tubulars are preferably formed as part of the conveying device, i.e. they are directly connected to each other in the form of a tubular chain.

The cleaning assembly further contains means and/or stations and/or cleaning cycles, which are especially adapted to the use of the tubulars according to the disclosure.

A spray nozzle cleaning has the advantage that a plurality of cleaning agents can be used and that caused by the different spray pressures a mechanical treatment can be achieved and can be precisely metered concerning its intensity.

BRIEF DESCRIPTION OF THE DRAWINGS

An embodiment of the disclosure will now be described in detail by means of the drawings.

DETAILED DESCRIPTION OF THE PREFERRED EMBODIMENT

Figure 1:
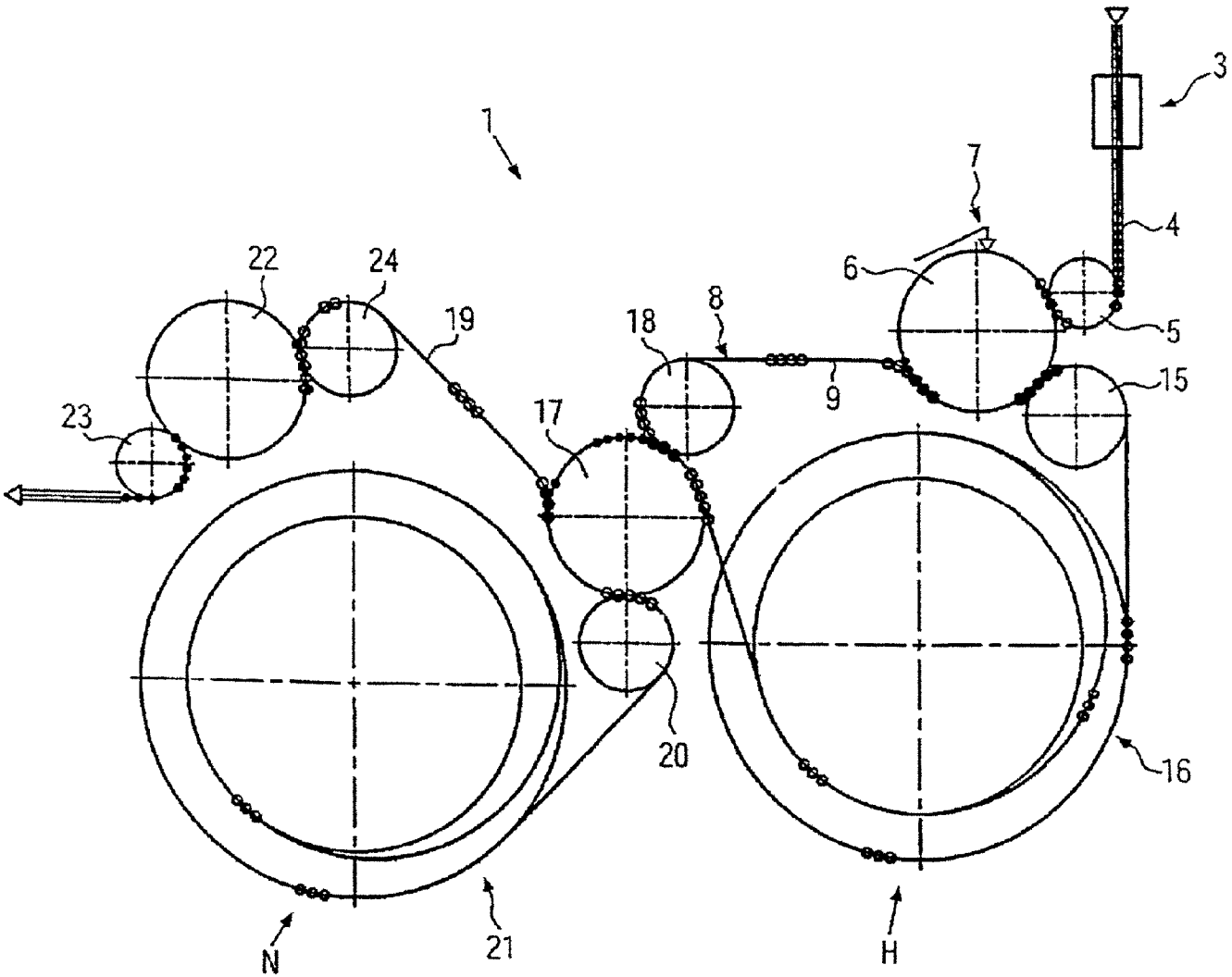
FIG. 1 shows a schematic view of a cleaning assembly according to the disclosure.
Figure 2:
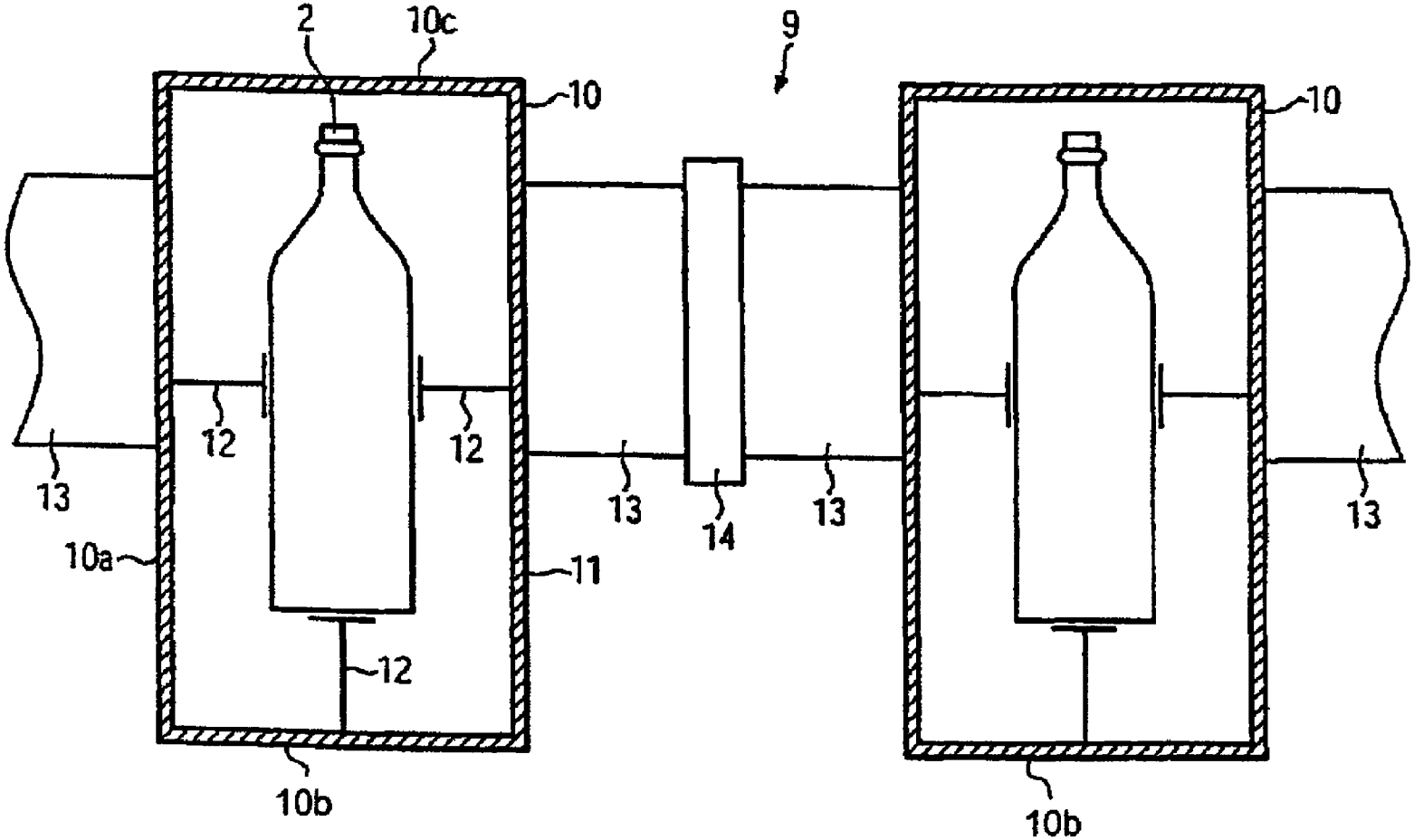
FIG. 2 shows a schematic view of a conveying device for the cleaning assembly according to FIG. 1.

A cleaning assembly 1 for containers 2, particularly for reusable packagings for beverages, can be seen in FIGS. 1 and 2, wherein the containers 2 in the embodiment shown are bottles. The containers 2 are made of plastics or glass, however, they can also be composed of any other cleanable material. For the following description it shall be assumed that the cleaning assembly 1 is adapted for cleaning reusable bottles, wherein the bottles are emptied from residues, are cleaned from the inside and outside and are freed from possibly adhering labels or shrinkable sleeves and the like. Depending on the type of the container to be cleaned, other cleaning steps and other precautions or assembly parts can also be required.

The cleaning assembly 1 comprises in the embodiment shown a pretreatment means 3 realized by a conventional design. The preferably mono-material containers enter the pretreatment means in one row. Caused by the known constructions, e.g. by means of support rails, the containers that are possibly already sprayed over are tilted in order to discharge them (preferably about approx. 100°) and are erected again. In tilted condition, they are preferably additionally set into rotation, e.g. via a belt drive to accelerate the discharging process and to support the forward movement of the containers. Subsequently, the containers are arranged to form a row with predetermined distances, which may for instance be implemented via a one-piece worm 4 and a run-in star 5. From this device the containers reach a rotary apparatus 6 to which a means for removing and/or perforating and/or cutting labels or shrinkable sleeves or the like is associated. The label removing means 7 preferably contains a laser that removes or perforates the labels to give the subsequently applied cleaning agent a greater contact surface.

The rotary apparatus 6 further offers the option to hand over the containers 2 to a conveying device 8 with an endlessly revolving conveyor 9. The conveying device contains, as shown in FIG. 2, a plurality of receptacle means for the containers 2, which according to the disclosure are formed as liquid-tight tubulars 10 and which allow an individual treatment of the containers 2. The expression "tubulars" means any type of receptacle capable of receiving both cleaning agent as well as at least one container 2 and to transport same over a conveying path. In the embodiment shown, each tubular 10 contains one container 2 each, however, it is also possible to design the tubulars in a manner that two or more containers 2 can be stored in one tubular 10.

The capacity and the shape of the tubular 10 are adapted to the shape and dimensions of the container 2 such that the container/s 2 can substantially completely be submersed into a cleaning agent bath located in the tubular 10. Although the containers can also be accommodated in horizontal fashion, it is preferred to design the tubulars 10 such that the container can be accommodated in the tubular in an upright manner, i.e. with a filling opening pointing upwards and can be submersed into the cleaning bath located there.

The tubular 10 contains a peripheral wall 10*a*, a bottom 10*b* and is preferably closed by a lid 10*c*. The tubular 10 is preferably heat-insulated, wherein the heat insulation in the embodiment shown extends over the peripheral wall 10*a*, the bottom 10*b* and the lid 10*c*.

Spacers 12 are provided in the interior of the tubular 10, said spacers holding the container 2 at a distance to the tubular 10 so that it can be washed around on all sides by the cleaning bath.

Means for intensifying the cleaning effect (which are not shown) can be provided in the tubular 10 itself and/or at the conveying device 8 and/or along the conveying path of the conveying device 7, said means enforcing the cleaning effect by a turbulence in the cleaning bath, i.e. a relative movement between the cleaning bath and the container 2. Turbulences can for instance be generated by an air effervescence in the tubular 10, a sonotrode for ultrasonic cleaning, a magnetic drive with an internal magnetic stirrer or the like.

The conveyor 9 of the conveying means 8 consists, as shown in FIG. 2, preferably of tubulars 10 directly connected to one another in the form of a tubular chain. The connection is carried out in the embodiment shown via connecting flaps 13, each being fixedly connected to the tubulars 10, and which project from the tubular 10 the opposing sides. The connecting flaps of two adjoining tubulars 10 are connected to one another via a hinge 14. The hinge 14 allows those degrees of freedom of a relative movement of two adjoining tubulars 10 that are required in the course of the conveying path, as will be described hereinafter.

The containers 2 are inserted by the rotary apparatus 6 into the tubulars 10 of the conveying device. This is preferably implemented by lowering the rotary apparatus into the tubulars passed by underneath. Before or after insertion into the tubulars 10, the containers 2 are filled with cleaning agent. Subsequently, the tubulars 10 and the containers 2 arranged therein are guided into a reversing loop or transfer conveyor in which the tubulars 10 are filled with cleaning agent in a manner that the containers 2 are fully filled with cleaning agent.

Any known cleaning agent, particularly cleaning base can be used as cleaning agent, which was also formerly used for cleaning these containers 2. To clean reusable packagings, such as bottles, a cleaning base is preferably used which was heated to approx. 60° C. This is a further advantage compared to the cleaning of the containers in conventional base baths, in which the base has to be heated to 80° C. In most cases, the same cleaning agent will be located in the container 2 and in the tubular 10, however, it is also possible to use different cleaning agents and/or different concentrations within and outside of the container 2.

The tubulars 10 filled with cleaning agent and the containers 2 reach from the transfer conveyor 15 into a dwell time area 16 so that the cleaning agent can contact the container 2 for a time required for a thorough cleaning. The dwell time area 16 is formed by a respectively long dimensioned conveying path, which in the example shown is designed in the form of a treatment tower at whose periphery the endless conveyor 9, guided by respective guides, is guided spirally or in the form of a helix up and down in the internal and external circuit. The required process times are achieved by an optimal dimensioning of the helical diameters and the number of windings. At least during the conveying movement through the dwell time area 16 the possibly existing means for intensifying the cleaning effect is set into operation, i.e. particularly the cleaning agent in the tubular 10 and/or in the container 2 is set into turbulences, e.g. in that the air effervescence is switched on.

After running through the dwell time area 16, the endless conveyor 9 reaches a further rotary apparatus 17 by means of which the containers 2 are lifted out of the tubulars 10 and are emptied, e.g. by tilting. The endless conveyor 9 with the tubulars 10 reaches a circulation means 18 at which the tubulars 10 are emptied and cleaned. The base is subsequently recycled. Subsequently, the empty tubulars return to the rotary apparatus 6, where newly arriving containers 2 are either first lowered into the tubulars 10 and are subsequently filled or are first filled and then lowered into the tubulars 10.

The containers 2 accepted and emptied by the rotary apparatus 2 can then be supplied to any suitable further procedure or, if the cleaning process is terminated, they can be subjected to a washing and drying process or to a storing process.

After the above described first cleaning cycle H, which serves for main cleaning, the containers 2 preferably run through a second cleaning cycle N for a post-cleaning, particularly for sterilization and rinsing, which in view of its constructive design basically corresponds to the first cleaning cycle H with the first rotary apparatus 6, the endless conveyor 9, the transfer conveyor 15, the dwell time area 16 and the transfer conveyor 18.

The second cleaning cycle N starts at a rotary apparatus, i.e. at the rotary apparatus 17 at which the containers are lowered into the tubulars 10 of a further endless conveyor 19, which corresponds to the endless conveyor 9 in terms of construction. Before and after lowering, the containers 2 are filled with a cleaning agent. Subsequently, the tubulars 10 filled with the containers 2 are transferred to a transfer conveyor 20, which corresponds to the transfer conveyor 15. The tubulars 10 are filled there. During the second cleaning cycle, the filling of the containers and/or tubulars with a cleaning agent takes place, which preferably differs from the cleaning agent in the first cycle. Particularly, the cleaning agent in the second cleaning cycle is also a base, however having a lower temperature of approx. 50° C. Caused by the individual treatment of the containers 2 in the tubular 10, cleaning tablets can economically also be used, e.g. for a effervescence cleaning or a neutralization of the pH value.

The endless conveyor 19 with the filled tubulars 10 and containers 2 reaches into the dwell time area 21, which is also formed as a treatment tower around which the endless conveyor 19 is wound in upward and downward helixes in the inner and outer circuit guided through respective guides. In this case, the cleaning effect can also be enforced by the generation of turbulences.

Behind the end of the dwell time area 21, the endless conveyor 19 reaches a third rotary apparatus 22, the so-called rinser, where the containers 2 are emptied and lifted out of the tubulars 10. Subsequently, the containers 2 are conveyed over the guide rail across a short arcuate segment along the periphery of the rotary apparatus 22 and are rinsed, e.g. by a spray treatment with fresh water. After rinsing, the containers reach into an exit conveyor 23, where the cleaning result is possibly monitored and the containers are taken off for further processing.

The endless conveyor 19 with the tubulars reaches via a deflection conveyor 24 back to the second rotary apparatus 17, wherein the tubulars are also emptied and possibly rinsed, e.g. by using the exhaust water produced during rinsing of the container 2 at the rinser 22.

The advantages according to the disclosure are also achieved if only one of the two cleaning cycles, particularly the cleaning cycle H, is carried out with the containers accommodated in the tubulars. A favorable cleaning effect is also achieved if the dwell time area 21 in the second cleaning cycle N is designed for a spray treatment. For this purpose, the endless conveyor 19 does no contain a liquid-tight tubular, but supports, which do not hold back the liquid, i.e. either supports for freely suspending the containers 2 or baskets or comparable receptacle means. In this manner the containers 2 when running through the dwell time area 21 can be treated by spray or high pressure nozzles. This has the decisive advantage that the containers 2 can be treated in the dwell time area 21 successively or simultaneously by different cleaning agents. The containers 2 can for instance be treated in any winding or helix at the treatment tower with a different cleaning agent, including fresh water. The cleaning liquids are collected at the end of each helix and are pumped for further application or for recycling. The nozzles used for treatment can be arranged stationarily or they can be moved on sectional paths or on the entire area together with the endless conveyor 19. The baskets or suspensions can be changed in inclination by guide rails so that an intensive additional internal and external cleaning is ensured. This variant enables a gentle temperature application, an optimum cleaning effect and adjustment option of the cleaning intensity via pressure, temperature and flow rate of the cleaning media and is therefore environmentally friendly. The spray treatment described does not necessarily have to be used together with a treatment of the containers in the tubular. On the other hand, tubulars with closable discharge openings can be used, which depending on the requirements can be used either in closed manner for a submersion treatment or in opened manner for a spray treatment.

As a modification of the embodiments described and drawn, different conveying means can be used instead of the rotary apparatus and treatment towers etc. shown. It is also not necessarily required to arrange the tubulars at an endless conveyor, or to compose them to form an endless conveyor. The tubulars can also be supported by rotary apparatus, belt conveyors or the like. The main and after treatment of the containers in the two cleaning cycles can be replaced by one single cleaning process.

We claim:

1. Cleaning assembly for containers, comprising a conveying device on which the containers are arranged by the aid of a receptacle means, and the receptacle means contains a liquid-tight tubular, a first cleaning cycle is provided for a main cleaning process and a second cleaning cycle is provided for one of a post-cleaning process, a rinsing process, or a combination thereof, wherein at least the first cleaning cycle contains an endless conveyor provided with liquid-tight tubulars, and wherein at least the first cleaning cycle comprises a means for filling the container with a cleaning agent, a means for filling the tubular with a cleaning agent and a means for inserting the container into the tubular.

2. Cleaning assembly according to claim 1, wherein the tubular has a capacity that is sufficient for substantially completely receiving at least one container.

3. Cleaning assembly according to claim 1, wherein the tubular has a capacity that is sufficient for receiving at least one upright standing container having a filling opening that points upwards.

4. Cleaning assembly according to claim 1, wherein the tubular is heat-insulated.

5. Cleaning assembly according to claim 1, wherein the tubular is equipped with a means for intensifying the cleaning effect.

6. Cleaning assembly according to claim 1, wherein the tubular comprises spacers for the container.

7. Cleaning assembly according to claim 1, wherein the tubular is closable.

8. Cleaning assembly according to claim 1, wherein the conveying device contains a plurality of tubulars connected to one another to form a chain.

9. Cleaning assembly according to claim 1, and a filling and discharge station for the tubular is arranged at the conveying device.

10. Cleaning assembly according to claim 1, and a filling and discharge station for the container is arranged at the conveying device.

11. Cleaning assembly according to claim 1, wherein the conveying device comprises a dwell time area.

12. Cleaning assembly according to claim 11, wherein the dwell time area is formed as one of a spirally or helically shaped conveying path.

13. Cleaning assembly according to claim 1, and spray nozzles for spray cleaning the containers.

14. Cleaning assembly of claim 1, wherein the containers are bottles.

* * * * *